US007052419B2

(12) United States Patent
Chang

(10) Patent No.: US 7,052,419 B2
(45) Date of Patent: May 30, 2006

(54) BALL BAT

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 10/864,576

(22) Filed: Jun. 10, 2004

(65) Prior Publication Data

US 2005/0277497 A1 Dec. 15, 2005

(51) Int. Cl.
*A63B 59/06* (2006.01)

(52) U.S. Cl. ..... 473/566; 473/567

(58) Field of Classification Search ..... 473/519, 473/520, 457, 569–568
See application file for complete search history.

(56) References Cited

U.S. PATENT DOCUMENTS

| | | | | |
|---|---|---|---|---|
| 1,665,195 | A * | 4/1928 | Cohn | 473/520 |
| 2,379,006 | A * | 6/1945 | Johnson | 473/568 |
| 3,877,698 | A * | 4/1975 | Volpe | 473/520 |
| 4,898,386 | A * | 2/1990 | Anderson | 473/457 |
| 4,951,948 | A * | 8/1990 | Peng | 473/520 |
| 5,219,164 | A * | 6/1993 | Peng | 473/520 |
| 5,303,917 | A * | 4/1994 | Uke | 473/567 |
| 5,593,158 | A * | 1/1997 | Filice et al. | 473/520 |
| 6,432,006 | B1 * | 8/2002 | Tribble | 473/564 |
| 6,485,382 | B1 * | 11/2002 | Chen | 473/566 |
| 6,511,392 | B1 * | 1/2003 | Chohan | 473/564 |
| 6,609,984 | B1 * | 8/2003 | Tribble | 473/564 |
| 2003/0013563 | A1 * | 1/2003 | Ryan | 473/457 |

* cited by examiner

*Primary Examiner*—Mark S. Graham
(74) *Attorney, Agent, or Firm*—Browdy and Neimark, PLLC

(57) ABSTRACT

A ball bat includes a handle portion, a tubular core, a middle device and a striking portion. The handle portion is made of plastics or wooden materials and has a front end, a rear end and a body between them. The tubular core is made of fiber reinforced plastic materials or metal and is embedded in the body of the handle portion. The striking portion is made of fiber reinforced plastic materials or metal and has a front end, a rear end and a body between them. The middle device has a predetermined weight and elasticity and is positioned between the front end of the handle portion and the rear end of the striking portion such that the handle portion and the striking portion can be connected to be a whole bat.

22 Claims, 3 Drawing Sheets

BALL BAT

BACKGROUND OF THE INVENTION

1. Field of the Invention

The present invention relates to appliances for striking baseball or the likes, more particularly, to an improved bat for baseball or the likes, which has an enlarged sweet striking area and a superior shock-absorbing capability.

2. Description of the Related Art

When playing a game needed appliances to strike or hit balls, such as baseball, wooden bats are most popularly used because they are the cheapest ones. However, wooden bats have numerous drawbacks, such as small sweet striking area, heavy weight and bad equilibrium. Furthermore, a wooden bat is weak and easy to break, and produces severe shocks when hitting the ball.

In comparison to wooden bats, an aluminum bat is relatively lighter in weight, and has an ideal equilibrium. Therefore, the performance of an aluminum bat is superior to conventional wooden bats, and an aluminum bat is more durable than conventional wooden bats. Further, the price of aluminum bats is reasonable. However, an aluminum bat produces shocks, noises and dents at barrel when hitting the ball. Specially, the sweet striking area of the aluminum bat as that of the wooden bat is small.

The recently developed bats made of fiber reinforced plastic (FRP) material have the ideal counterweight and equilibrium and high performance in hitting. In addition, a FRP bat has a strong structural strength, and does not break easily. However, The problems are that the FRP bat is too expensive to get a popular use, also has a small sweet striking area, and cannot absorb effectively the shock produced when hitting the ball.

SUMMARY OF THE INVENTION

The primary object of the present invention is to provide an improved bat having an enlarged sweet striking area, a superior shock-absorbing capability, a lightweight, a good equilibrium, and a high structural strength.

Thus, the bat according to the aspect of the present invention comprises a handle portion, a tubular core, a middle device and a striking portion. The handle portion is made of plastics or wooden materials and has a front end, a rear end and a body between them. The body of the handle portion has an outer diameter increasing gradually from the front end to the rear end. The tubular core is made of fiber reinforced plastic materials or metal and is embedded in the body of the handle portion. The striking portion is made of fiber reinforced plastic materials or metal and has a front end, a rear end and a body between them. The middle device has a predetermined weight and elasticity and is arranged between the front end of the handle portion and the rear end of the striking portion such that the handle portion and the striking portion can be connected to be a whole bat.

BRIEF DESCRIPTION OF THE DRAWINGS

This and other objects of the present invention will become more clear upon a through study of the following description of the best mode for carrying out the present invention, particularly when reviewed in conjunction with the drawings, wherein.

DETAILED DESCRIPTION OF PREFERRED EMBODIMENTS

Figure 1:
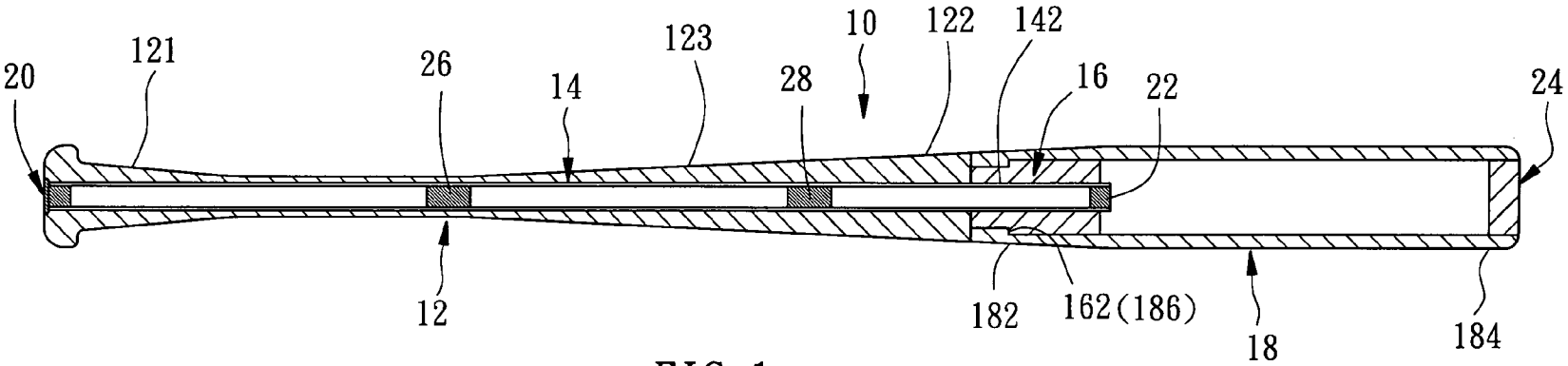
FIG. 1 is a longitudinal sectional view of a baseball bat constructed according to the first embodiment of the present invention.

With reference first to FIG. 1, a baseball bat, referenced by 10, in accordance with the first embodiment of the present invention is shown comprising a handle portion 12, a tubular core 14, a middle device 16, and a striking portion 18.

The handle portion 12 may be made of plastic materials, such as polyurethane (PU), or wooden materials. The handle portion 12 has a front end 121, a rear end 122 and a body 123 between them. The outer diameter of the body 123 is increased gradually from the front end 121 to the rear end 122.

The tubular core 14 is made of rigid and lightweight materials, such as composite materials, metals and plastics. In this embodiment, it is a carbon-fiber reinforced epoxy resin. The core 14 is longitudinally embedded in the axis of the handle portion 12. Generally, the length of the core 14 is longer than that of the handle portion 12 such that the core 14 has an exposed section 142 protruding the rear end 122 of the handle portion 12. A front and rear plugs 20, 22 are inserted respectively inside the two ends of the core 14.

The middle device 16 may be made of wooden, plastic or rubber materials. In this embodiment, it is a wooden ring and is penetrated through by the exposed section 142 of the core 14.

The striking portion 18 may be made of metals, such as aluminum, titanium, or composite materials, such as fiber reinforced plastics. Generally, the striking portion 18 is a barrel with a front end 182 and a rear end 184. The middle device 16 with the exposed section 142 penetrating therethrough is inserted inside the front end 182 of the striking portion 18. A first annular shoulder 162 is formed on the surface of the middle device 16. A second annular shoulder 186 being complementary to the first annular shoulder 162 is formed on the inside surface of the striking portion 18 to attach to the first annular shoulder 162 such that the handle portion 12 can connect tightly with the striking portion 18 to form the whole bat 10.

In this embodiment, the bat 10 further includes two shock-absorbing members 26,28, which are cylindrical members respectively made of shock-absorbing materials such as foamed plastic, cloth or cork, are tightly inserted into the inside of the tubular core 14 at selected locations. The shock-absorbing members 26,28 can be made having a certain weight to work as weight devices for adjusting the center of gravity of the bat 10.

As mentioned above, the bat according to the present invention is combined by two portions. Each portion can be made of different materials according to the needs thereof. Thus, a baseball bat, which has a shock-absorbable, resilient and lightweight handle portion and a rigid striking portion, can be provided. For embedding therein a reinforced core, the handle portion of the bat has a high structural strength.

In addition, for having the middle device positioned between the handle portion and striking portion, the bat has a relatively lower specific gravity than conventional bats such that the sweet striking area thereof is enlarged. Furthermore, the middle device can absorb shocks arisen from the striking portion hitting a pitched ball.

Figure 2:
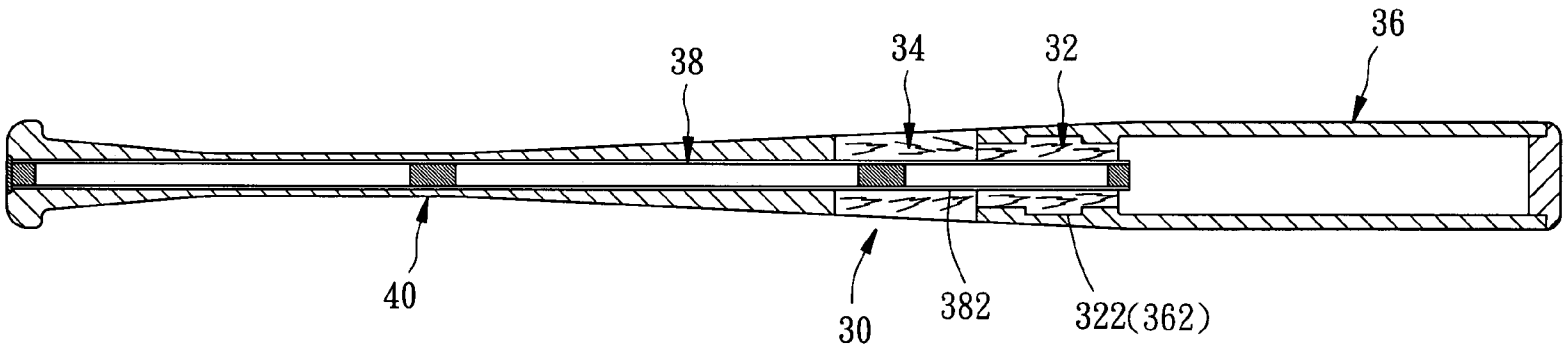
FIG. 2 is a longitudinal sectional view of a baseball bat constructed according to the second embodiment of the present invention.

According to the aspect of the present invention, there are other embodiments described as follows:

FIG. 2 shows a baseball bat 30 constructed according to the third embodiment of the present invention. The bat 30 is similar to the bat 10 of the first embodiment. The difference is that the bat 30 includes a first middle device 32 and a second middle device 34. The first middle device 32 is penetrated through by the exposed section 382 of the core 38 and inserted inside the front end of the striking portion 36. The second middle device 34 is also penetrated through by the exposed section 382 of the core 38 but is placed in between the striking portion 36 and the handle portion 40. In addition, the first middle device 32 has an annular protruding 322 formed on the surface thereof. The annular protruding 322 is received in an annular ditch 362 formed on the inside surface of the striking portion 36.

Figure 3:
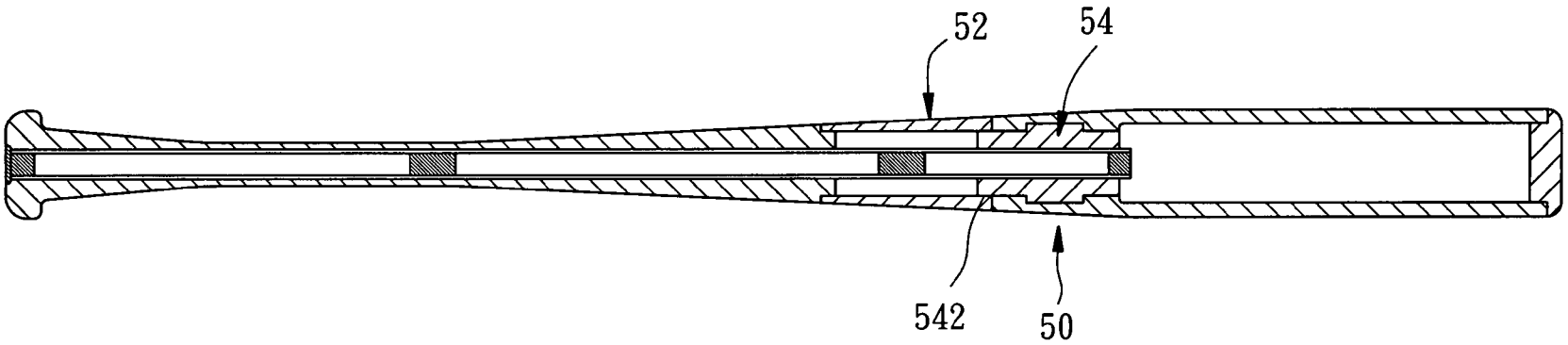
FIG. 3 is a longitudinal sectional view of a baseball bat constructed according to the third embodiment of the present invention.

FIG. 3 shows a baseball bat 50 constructed according to the third embodiment of the present invention. According to this embodiment, the bat 50 is similar to the bat 30 of the second embodiment. The difference is that the second middle device 52 of the bat 50 is a plastic ring. The first middle device 54 has an exposed part 542 inserted inside the second middle device 52.

Figure 4:
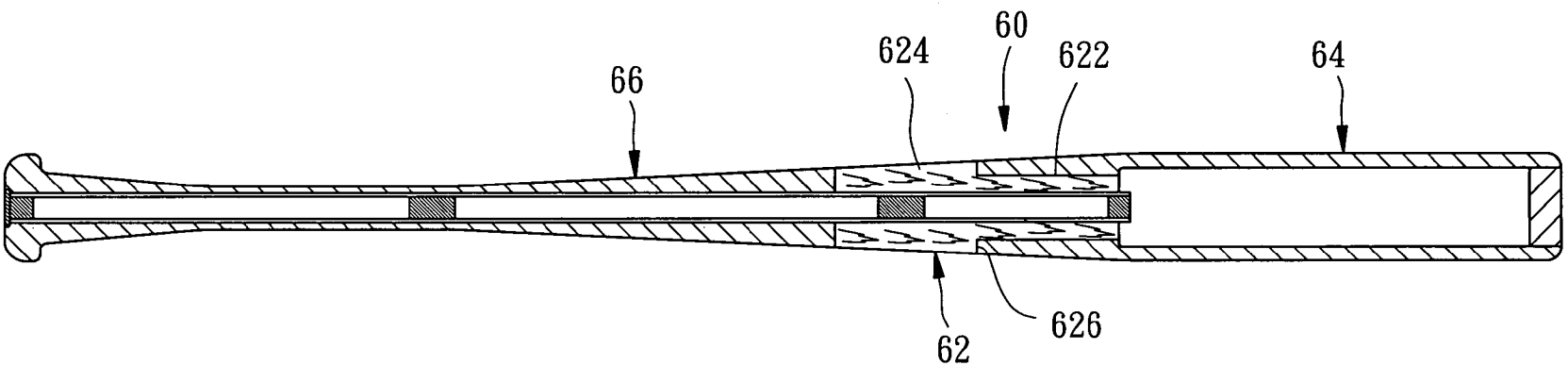
FIG. 4 is a longitudinal sectional view of a baseball bat constructed according to the fourth embodiment of the present invention.

FIG. 4 shows a baseball bat 60 constructed according to the fourth embodiment of the present invention. According to this embodiment, the bat 60 is similar to the bat 30 of the second embodiment. The difference is that there is only one middle device 62 including an inserted part 622, an exposed part 624 and an annular shoulder 626 formed between them. The inserted part 622 is inserted inside the front end of the striking portion 64. The exposed part 624 is placed in between the striking portion 64 and the handle portion 66. The annular shoulder 626 is attached to the side surface of the front end of the striking portion 64.

Figure 5:
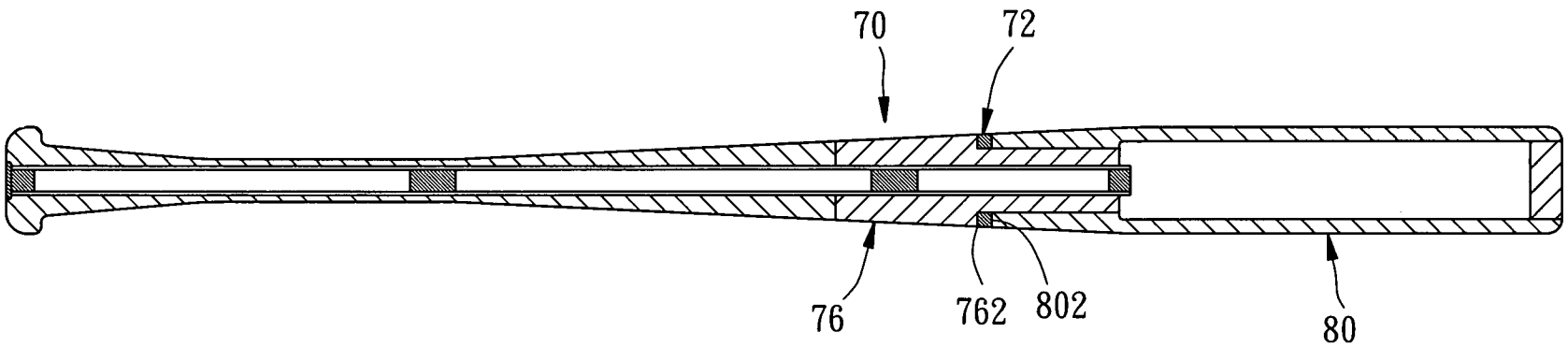
FIG. 5 is a longitudinal sectional view of a baseball bat constructed according to the fifth embodiment of the present invention.

Lastly referring to FIG. 5, it shows a baseball bat 70 constructed according to the fifth embodiment of the present invention. According to this embodiment, the bat 70 is similar to the bat 60 of the fourth embodiment. The difference is that the bat 70 further includes an elastic ring 72. The elastic ring 72 is placed in between the annular shoulder 762 of the middle device 76 and the side surface 802 of the front end of the striking portion 80.

What is claimed is:

1. A bat for striking baseballs or the likes, comprising:

a handle portion made of plastics or wooden materials, which has a front end, a rear end and a body between them, said body having an outer diameter increasing gradually from said front end to said rear end;

a tubular core made of fiber reinforced plastic materials or metal, which is embedded in the body of said handle portion;

a striking portion made of fiber reinforced plastic materials or metal, which has a front end, a rear end and a body between them;

at least a middle device having a predetermined weight and elasticity, which is positioned between the rear end of said handle portion and the front end of said striking portion in such a way that said handle portion and said striking portion can be connected to be a whole bat; and wherein said middle device is made of wooden materials.

2. The bat as claimed in claim 1, wherein said middle device has an inserted part inserted inside the front end of said striking portion.

3. The bat as claimed in claim 1, wherein said tubular core has an exposed section penetrating through said middle device.

4. The bat as claimed in claim 1, further comprising at least one weight device respectively and tightly inserted inside said core.

5. The bat as claimed in claim 1, further comprising at least one shock-absorbing device respectively and tightly inserted inside said core.

6. A bat for striking baseballs or the likes, comprising:

a handle portion made of plastics or wooden materials, which has a front end, a rear end and a body between them, said body having an outer diameter increasing gradually from said front end to said rear end;

a tubular core made of fiber reinforced plastic materials or metal, which is embedded in the body of said handle portion with an exposed section thereof protruding the rear end of said handle portion a predetermined length;

a striking portion made of fiber reinforced plastic materials or metal, which has a front end, a rear end and a body between them;

a first middle device having a predetermined weight and elasticity, which is penetrated through by said exposed section and is inserted inside the front end of said striking portion to connect said striking portion with said handle portion to form a whole bat; and wherein said first middle device is made of wooden materials.

7. The bat as claimed in claim 6, wherein said first middle device and said striking portion are formed respectively a complementary contacting area to tightly connect each other.

8. The bat as claimed in claim 6, further comprising a second middle device having a predetermined weight and elasticity, which is positioned to be next to said first middle device and penetrated through by said exposed section of said core such that said second middle device can be placed in between said handle portion and said striking portion.

9. The bat as claimed in claim 8, wherein said second middle device is made of wooden materials.

10. The bat as claimed in claim 8, wherein said second middle device is a ring made of plastic materials.

11. The bat as claimed in claim 6, further comprising at least one weight device respectively and tightly inserted inside said core.

12. The bat as claimed in claim 6, further comprising at least one shock-absorbing device respectively and tightly inserted inside said core.

13. A bat for striking baseballs or the likes, comprising:

a handle portion made of plastics or wooden materials, which has a front end, a rear end and a body between them, said body having an outer diameter increasing gradually from said front end to said rear end;

a tubular core made of fiber reinforced plastic materials or metal, which is embedded in the body of said handle portion with an exposed section thereof protruding the rear end of said handle portion a predetermined length;

a striking portion made of fiber reinforced plastic materials or metal, which has a front end, a rear end and a body between them;

a first middle device having a predetermined weight and elasticity, which includes an inserted part and an exposed part, said first middle device being penetrated through by said exposed section of said core in such a way that said inserted part is inserted inside the front end of said striking portion and said exposed part is positioned between the rear end of said handle portion and the front end of said striking portion; and wherein said first middle device is made of wooden materials.

14. The bat as claimed in claim 13, wherein the inserted part of said first middle device and the inside of the front end of said striking portion provide respectively a complementary contacting area to tightly connect each other.

15. The bat as claimed in claim 13, wherein said first middle device further includes an annular shoulder formed between said inserted part and said exposed part, said annular shoulder being attached to the side surface of said front end of said striking portion.

16. The bat as claimed in claim 15, further comprising an elastic ring placed in between said annular shoulder of said first middle device and the side surface of said front end of said striking portion.

17. The bat as claimed in claim 13, further comprising a second middle device having a predetermined weight and elasticity, which is positioned to be next to said first middle device and penetrated through by said exposed section of said core such that said second middle device can be placed in between said handle portion and said striking portion.

18. The bat as claimed in claim 17, wherein said exposed part of said first middle device is inserted inside one end of said second middle device.

19. The bat as claimed in claim 17, wherein said second middle device is made of wooden materials.

20. The bat as claimed in claim 17, wherein said second middle device is a ring made of plastic materials.

21. The bat as claimed in claim 13, further comprising at least one weight device respectively and tightly inserted inside said core.

22. The bat as claimed in claim 13, further comprising at least one shock-absorbing device respectively and tightly inserted inside said core.

* * * * *